US005673619A

United States Patent [19]

Ohinata et al.

[11] Patent Number: 5,673,619

[45] Date of Patent: Oct. 7, 1997

[54] ROTARY STENCIL PRINTER WITH A FIRMING FOLD APPLICATION MEANS

[75] Inventors: Yoshiharu Ohinata; Nagon Takita, both of Minato, Japan

[73] Assignee: Riso Kagaku Corporation, Tokyo, Japan

[21] Appl. No.: 536,636

[22] Filed: Sep. 29, 1995

[30] Foreign Application Priority Data

Oct. 11, 1994 [JP] Japan ..... 6-271685

[51] Int. Cl.[6] ..... B41L 13/14

[52] U.S. Cl. ..... 101/116; 101/128.21; 101/477; 271/161

[58] Field of Search ..... 101/116–118, 121, 101/122, 128.21, 128.4, 477; 271/161, 188, 209

[56] References Cited

U.S. PATENT DOCUMENTS

| | | | |
|---|---|---|---|
| 3,550,935 | 12/1970 | Smith | 271/188 |
| 5,094,660 | 3/1992 | Okuzawa | 271/188 |
| 5,152,522 | 10/1992 | Yamashita | 271/166 |
| 5,154,410 | 10/1992 | Baader et al. | 271/188 |

FOREIGN PATENT DOCUMENTS

| | | | |
|---|---|---|---|
| 2531549 | 1/1977 | Germany . | |
| 3146208 | 6/1983 | Germany . | |
| 16787 | 1/1984 | Japan | 101/128.4 |
| 64-80583 | 9/1987 | Japan . | |
| 64-80583 | 3/1989 | Japan . | |
| 2110191 | 6/1983 | United Kingdom . | |

OTHER PUBLICATIONS

Patent Abstracts Of Japan, vol. 8, No. 104 (M–296), 16 May 1984 & JP–A–59 016789 (Matsushita Denki Sangyo KK) 27 Jan. 1984.

Patent Abstracts Of Japan, vol. 11, No. 157 (M–590) 21 May 1987 & JP–A–61 287781 ( Risu Kagaku Corp) 18 Dec. 1986 *abstract*.

*Primary Examiner*—Stephen R. Funk
*Attorney, Agent, or Firm*—Watson Cole Stevens Davis, P.L.L.C.

[57] ABSTRACT

Firming folds for increasing the firmness of the stencil itself are generated at a leading end of the stencil to be mounted to a cylindrical printing drum of a rotary stencil printer or a trailing end of the stencil mounted to the printing or both. To do so, a pair of rollers one of which has projections to form the folds at the stencil are provided to feed the stencil therebetween toward a stencil leading end mounting means of the printing drum positioned at a standby position.

17 Claims, 11 Drawing Sheets

ROTARY STENCIL PRINTER WITH A FIRMING FOLD APPLICATION MEANS

BACKGROUND OF THE INVENTION

1. Field of the Invention

The present invention relates to a rotary stencil printer, and more particularly to providing a stencil feed means of a rotary stencil printer with a means for giving a firmness to a leading end or a trailing end or both of a one sheet part of the stencil so that the mounting of the leading end of the stencil to a cylindrical printing drum of the printer is facilitated by the leading end of the stencil being given the firmness, or the trailing end of the stencil floating from the printing drum with no ink supplied therebetween and therefore not adhered to the arcuate outer circumferential surface of the cylindrical printing drum by the the adhesiveness of the ink is held against rolling up from said arcuate outer circumferential surface of the printing down.

2. Description of the Prior Art

In the rotary stencil printer having a cylindrical printing drum equipped with a stencil leading end mounting means provided along a generatrix of the outer circumferential surface of the drum and a stencil feed means for feeding a stencil starting from a leading edge thereof toward the stencil leading end mounting means of the printing drum positioned at a standby position for receiving the leading end of the stencil to be mounted around the printing drum, it is generally expected that the leading end of the stencil fed out through a pair of stencil feed rollers provided at an exit end portion of the stencil feed means flies until it reaches and is caught by the stencil leading end mounting means depending upon the native firmness of the stencil.

However, the stencil feed rollers must be positioned not to interfere with the stencil leading end mounting means projecting substantially from the cylindrical outer circumferential surface of the printing drum during the rotation of the printing drum, and still further, the stencil feed rollers must be positioned to feed out the stencil toward the stencil leading end mounting means positioned at a standby position in a direction which is generally tangential to the outer circumferential surface of the cylindrical printing drum. Thus the stencil feed rollers must be unavoidably positioned to be substantially remote from the stencil leading end mounting means positioned at the standby position. Still further, for the same reason that the stencil leading end mounting means should not be interfered with by any obstacle during the rotation of the printing drum, no guide means is available between the stencil feed rollers and the stencil leading end mounting means positioned at the standby position. Therefore, the leading end of the stencil fed out from the stencil feed rollers must fly a relatively long distance with no guide means until it reaches the stencil leading end mounting means positioned at the standby position.

Particularly in a rotary stencil printer of such a construction that the stencil is supplied from a rolled source thereof as unrolled therefrom timely as required, or in a rotary stencil printer of such a construction that a one sheet part or a several sheets part of the stencil unrolled from a rolled source thereof is first perforated and thereafter stored in a perforated stencil storing chamber such that each one sheet part of the perforated stencil is drawn out from the perforated stencil storing chamber to be mounted around the printing drum, the stencil has a curl generated in a rolled state or a more irregular waving generated in the stored state in the perforated stencil storing chamber, so that the leading end of the stencil fed out from the stencil feed rollers may deviate greatly from a designed route in its course of proceeding toward the stencil leading end mounting means positioned at the standby position.

On the other hand, at the trailing end of a one sheet part of the stencil mounted around the cylindrical printing drum, generally no particular holding means is provided for the trailing end, and the length of a one sheet part of the stencil is generally so designed that a substantial length of the trailing end thereof extends beyond the ink penetrating portion of the printing drum for the purpose of preventing ink leakage, thus, such a relatively long trailing end of the stencil remains with no holding action being applied thereto from the circumferential surface of the printing drum via the adhesiveness of ink, and therefore, such a trailing end of the stencil can readily be bent up outward to float high up from the outer circumferential surface of the cylindrical printing drum. When this occurs, such a floating portion of the stencil touches parts of the printer located around the printing drum as the printing drum rotates, thereby generating a noise and/or picking up a drop of ink attached to one such part and giving it to other parts, causing an inadvertent ink contamination of the inside of the printer.

A bending deformation at the leading and trailing ends of the stencil can occur not only due to the above-mentioned curling generated in the rolled state or waving generated in the stored state but also due to a difference of thermal expansion when the stencil is a lamination of a thermoplastic resin film and an ink permeable sheet such as a Japanese paper, because the coefficient of thermal expansion is substantially different in those two different materials. Further, since the bending deformation of the stencil due to the difference of thermal expansion changes in the amount and direction according to temperature and humidity, it is more difficult to meet with this deformation.

SUMMARY OF THE INVENTION

It is the object of the present invention to solve the above-mentioned problems in the rotary stencil printer.

According to the present invention, the above-mentioned object is accomplished by a rotary stencil printer comprising a cylindrical printing drum equipped with a stencil leading end holding means provided at a part of an outer circumferential surface thereof along a generatrix thereof, and a stencil feed means for feeding a stencil starting from a leading edge thereof toward said stencil leading end holding means of said printing drum positioned at a standby position for mounting the stencil around said printing drum, wherein said stencil feed means comprises a firming fold application means which generates firming folds at at least one of a leading end portion of the stencil and a trailing end portion of a one sheet part of the stencil fed out thereby starting from the leading edge.

The above-mentioned rotary stencil printer may further comprise a stencil cut means provided between said printing drum and said stencil feed means, said stencil cut means being operationally correlated with said stencil feed means such that when said stencil feed means feeds out at least a two sheets part of the stencil, said stencil cut means cuts the stencil at the end of feeding out of a one sheet part of the stencil, wherein said firming fold application means generates firming folds at a portion of the stencil extending across a position thereof at which the stencil is cut by said stencil cut means.

In the above-mentioned rotary stencil printer, said firming fold application means may comprise a first roller having projections provided at a portion of an outer circumferential surface thereof to project from a cylindrical base surface thereof, and a second roller having an elastic cylindrical outer surface adapted to accept said projections of said first roller by an elastic local deformation thereof when said elastic cylindrical outer surface of said second roller approaches to said cylindrical base surface of said first roller such that said first and second rollers construct a feed roller means for feeding the stencil by holding the stencil therebetween.

Or, said firming fold application means may comprise a first roller having projections at a portion of an outer circumferential surface thereof projecting from a cylindrical base surface thereof, and a second roller having at least one groove at a portion of an outer circumferential surface thereof to be concaved from a cylindrical base surface thereof, said first and second rollers constructing a feed roller means for feeding the stencil by holding the stencil therebetween with said projections being aligned and engaged with said groove.

Further, in the above-mentioned two types of firming fold application means including the combination of said first roller and said second roller, said first roller may comprise a mechanism for moving said projections between an operating position thereof projecting from said cylindrical base surface thereof and a non-operating operating position housed below said cylindrical base surface thereof.

By providing such a firming fold application means as described above in the stencil feed means and thereby generating firming folds at a leading end of the stencil when it is fed toward the stencil leading end mounting means of the cylindrical printing drum starting from the leading end, the leading end of the stencil fed out from the stencil feed means stabilizes a flying route thereof toward the stencil leading end mounting means by the firmness thereof such that the leading end of the stencil can definitely reach the stencil leading end mounting means in a predetermined posture without being guided by any outer guide means.

The rotary stencil printers to which the present invention is applied are generally so constructed that, when the leading end of the stencil fed by the stencil feed means reached the stencil leading end mounting means of the cylindrical printing drum and was clamped thereby, the printing drum and the stencil feed means operate in synchronization with one another, until the printing drum makes approximately one rotation, with the stencil mounted at the leading end to an outer circumferential portion extending along a generatrix of the printing drum by the stencil leading end mounting means being tightly wrapped therearound as it rotates, under application of a tension by the stencil feed means which holds the stencil until a one sheet part of the stencil has been fed. Therefore, if the firming fold application means according to the present invention is operated while the stencil feed means is supporting a trailing end of the one sheet part of the stencil, then firming folds can be generated at the trailing end of the one sheet part of the stencil by the same firming fold application means which generates the firming folds at the leading end of the stencil. By the trailing end portion of the stencil being thus formed with the firming folds, the trailing end of the stencil not held by the outer circumferential surface of the printing drum via the ink adhesiveness is stably held from the portion thereof held on the circumferential surface of the printing drum by via the ink adhesiveness so as to extend in a direction tangential to the outer circumferential surface of the cylindrical printing drum, preventing the trailing end of the stencil from making a large outward bend.

Furthermore, the firming fold application means according to the present invention maybe incorporated in a rotary stencil printer which has a stencil cut means between the cylindrical printing drum and the stencil feed means and operates such that at least a two sheets part of the stencil is fed out at a time from a rolled stencil source or the like and the stencil cut means is so operated that, when a one sheet part of the stencil has been fed toward the printing drum by the stencil feed means, the stencil is cut into individual one sheet parts. Then, if the firming fold application means is operated against a part of the stencil where it is cut into two sheet parts and including an area corresponding to the trailing end of the sheet part of the stencil which has been mounted around the printing drum and an area corresponding to the leading end of the succeeding sheet part for the next printing operation, the trailing end of the preceding sheet part of the stencil and the leading end of the succeeding sheet part of the stencil are formed with the firming folds by a one time operation of the firming fold application means.

The firming fold according to the present invention may be generated at the stencil by holding the stencil between a first roller having projections at a part of the outer peripheral surface thereof as raised from the cylindrical base surface thereof and a second roller having an elastic cylindrical surface capable of accepting the projections of said first roller by a self local deformation when engaged with the cylindrical base of said first roller and feeding the stencil therebetween such that folds are formed at a part of the stencil by said projections. Another way to generate the firming fold according to the present invention is by holding the stencil between a first roller having projections at a part of the outer circumferential surface thereof as raised from a cylindrical base surface thereof and a second roller having grooves at a part of the outer peripheral surface thereof as lowered from the cylindrical base surface thereof and by feeding the stencil therebetween such that folds are formed at a part of the stencil to follow an engagement of the projections and the grooves. A plurality of such folds generated at the stencil according to the above-mentioned manner may be arranged in various patterns generally having a component of extension oriented in the direction of feeding of the stencil, as will be appreciated from several embodiments thereof described hereinbelow.

The leading end of the stencil before being held by the stencil leading end mounting means of the printing is desired to be substantially flat. Since the length and the width over which the leading end of the stencil should have a firmness while it is fed with no guide means are relatively large, it is desirable that the firming folds generated at the leading end of the stencil have a component of extension in the longitudinal as well as lateral directions of the stencil. Such folds are obtained by inclining each fold relative to the longitudinal direction of the stencil, or by dispersing a number of short folds in the lateral direction with a longitudinal shifting between each two adjacent ones. Since the firming folds at the trailing end of the stencil are formed over a relatively short length of the stencil, it will be sufficient if the firming folds give a longitudinal firmness.

The present invention may employ projections for forming the firming fold provided in one of a pair of rollers which presses and feeds the stencil and are constructed to be movable between an operating position thereof projecting from the cylindrical base surface of the roller carrying the projections and a non-operating position retracted below the cylindrical base surface as shown in one of the embodiments described hereinbelow. In such an embodiment, the firming fold application means according to the present invention may be incorporated in a stencil feed roller of the stencil feed means, such that, in a process of feeding the stencil through the stencil feed rollers, the projections are moved from the non-operating position to the operating position only when the roller incorporating the projections feed a portion of the stencil corresponding to the leading end of a one sheet part of the stencil or a portion of the stencil corresponding to the trailing end of the stencil. By such an arrangement, it can be avoided that the stencil feed roller must be shifted to be more remote from the cylindrical printing drum to find a space for mounting the firming fold application means between the stencil feed means and the cylindrical printing drum. A further advantage available by this construction will be described in the descriptions of the embodiment.

As will be appreciated from the descriptions of some preferred embodiments made hereinbelow, in the present specification the term "projections" of the firming fold application roller are generally used in the style of plurality to indicate the virtual condition of the firming fold application rollers according to various embodiments each of these rollers shows a plurality of discrete projections raised from the outer contour of the cylindrical base surface thereof when viewed in a plan view such that, when such a roller is pressed against the stencil and rotated with a help of a cooperating back press roller, a plurality of firming folds are generated at the stencil as arranged generally in parallel. However, such a plurality of folds arranged generally in parallel can be formed by a roller having a single helical projection. Therefore, in the present specification, when a particular construction of the means to form a plurality of parallel folds should be clarified as in the case of a helical projection, the means raised from the cylindrical base surface of the roller is expressed as a "convex". The same principle will be applied to the "grooves" formed at the roller mating with the roller having the projections.

BRIEF DESCRIPTION OF THE DRAWINGS

In the accompanying drawings.

DESCRIPTION OF THE PREFERRED EMBODIMENTS

In the following, the present invention will be described in more detail with respect to some preferred embodiments thereof with reference to the accompanying drawings.

Figure 1:
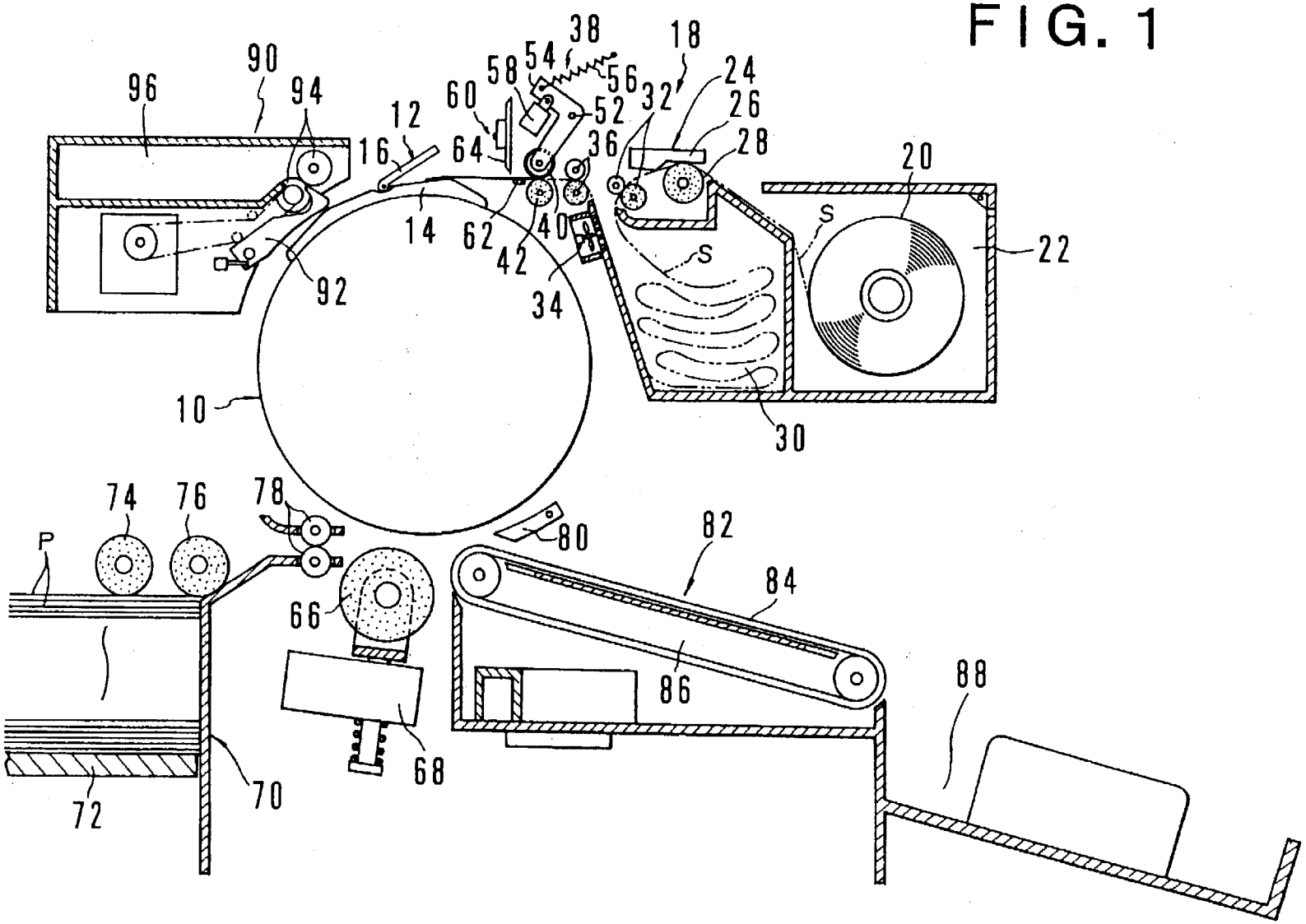
FIG. 1 is a longitudinal sectional view showing in a somewhat diagrammatical illustration an embodiment of the rotary stencil printer equipped with the firming fold application means according to the present invention.

Referring to FIG. 1 showing an embodiment of a rotary stencil printer equipped with the firming fold application means according to the present invention, 10 designates a cylindrical printing drum having a stencil leading end mounting means 12 disposed along a generatrix of the outer circumferential surface thereof. The stencil leading end mounting means includes a base 14 and a clamp plate 16 mounted to the base to be pivotable between an open position shown in the figure for receiving the leading end of the stencil on the base and a closed position to clamp and hold the leading end of the stencil on the base.

A stencil feed means for feeding the stencil toward the cylindrical printing drum is totally designated by reference numeral 18. The stencil feed means 18 comprises a stencil roll 20 serving as a stencil supply source, a roll chamber 22 for housing the stencil roll, a perforation means 24 for perforating the stencil S drawn out from the stencil roll according to an image and including a thermal head 26 having a large number of thermo-elements adapted to be selectively operated according to an electric signal representing an image to be perforated and a platen roller 28 for pressing the stencil against the thermal head, a pair of rollers 32 for feeding the perforated stencil into a perforated stencil storing chamber 30, a fan 34 for moderately attracting the perforated stencil so that it is regularly fed out from the storing chamber 30, a pair of stencil feed rollers 36 for feeding out the stencil from the storing chamber 30 toward the cylindrical printing drum 10, and a firming fold application means 38 according to the present invention. With regard to the above-mentioned construction components of the stencil feed means 18, the roll 20 - the roller pair 36 are of the same constructions as those shown in Japanese Patent Laid-open Publication 64-80583 of an application filed by the same assignee as that of the present application. In the rotary stencil printer described in said publication, there is provided a means which may appear to be similar to the firming fold application means 38 of the present invention as viewed in the present FIG. 1, said means of the publication including a roller means for forming a bulge at a part of the stencil coming into contact with a leading edge of a print sheet, said bulge being effective to let a part of the leading end of the print sheet coming into contact with a tip of a claw for separating the print sheet from the stencil mounted around the printing drum to be floated from the stencil such that the tip of the claw is definitely engaged into between the leading edge of the print sheet and the stencil at the end of the printing of the print sheet. However, the roller means shown in said publication is provided only at a central point of the width of the cylindrical printing drum 10 corresponding to the print sheet separation claw which corresponds to a claw 80 of which a description is made hereinbelow.

The firming fold application means 38 comprises a set of rollers 40 and 42 which are shown in more detail in FIGS. 2 and 3 or 4 and 5, the rollers extending over the full width of the stencil. In the embodiment shown in FIGS. 2 and 3, the roller 40 has an outer circumferential portion 44 made of a firm metal which is formed with a plurality of annular convexes which provide projections 48 raised from a cylindrical base surface 46. Those annular convexes or projections 48 are distributed over the whole length of the roller 40.

On the other hand, the roller 42, arranged in parallel with the roller 40 to cooperate therewith to press the stencil S therebetween so as to feed it while generating firming folds thereat, has at least an outer circumferential portion 50 made of a durable elastic material such as rubber so that the elastic layer can accept the projections 48 of the roller 40 by an elastic local deformation thereof when the rollers 40 and 42 are pressed against one another with the stencil S held therebetween so far that the outer circumferential surface of the elastic layer substantially contacts the cylindrical base surface of the roller 40. Therefore, when the stencil S is fed through these two rollers maintained in said mutually pressed condition, the stencil S is formed with firming folds F each having a cross sectional shape following the cross sectional shape of the projection 48. It is to be noted that in FIGS. 2 and 3 the thickness of the stencil S is enlarged relative to the diameter of the rollers 40 and 42 for the clarity of illustration. Further, the stencil S herein shown has a laminated structure made of a layer S1 of a thermoplastic synthetic resin and an ink permeable sheet S2 of entangled fibers such as a Japanese paper. Further, in the shown embodiment, the stencil S is fed between the rollers 40 and 42 with the synthetic resin layer S1 in contact with the roller 40 having the projections 48. However, this is not a condition necessary for generating the firming folds at the stencil. In contrast, the stencil may be fed between the rollers such that the ink permeable sheet S2 is in contact with the roller 40 having the projections.

Figure 5:
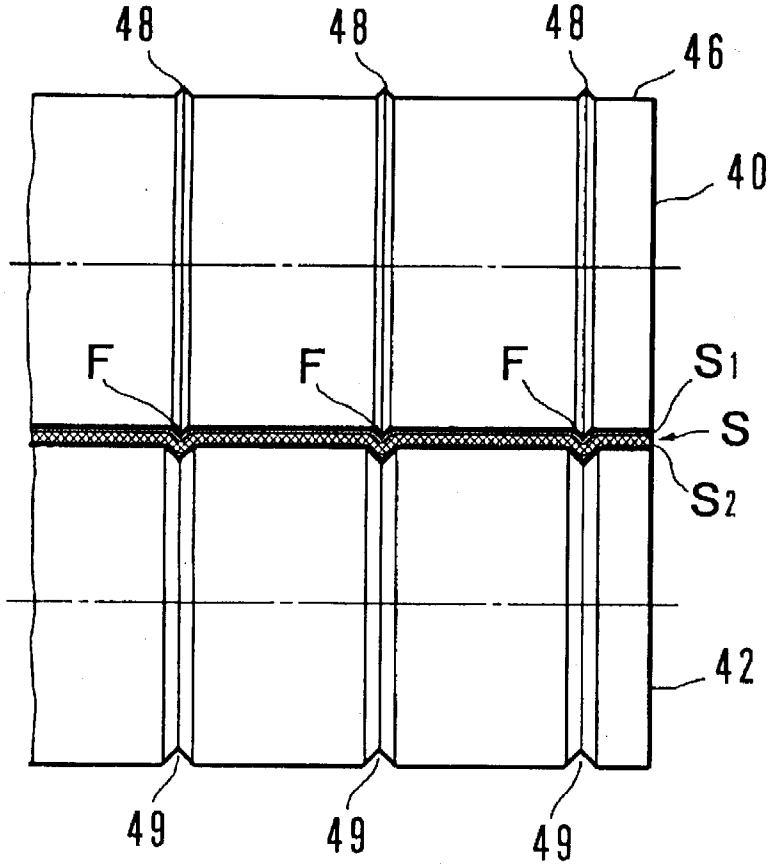
FIG. 5 is a partial front view corresponding to the construction shown in FIG. 4.

It is desirable in accomplishing the object of firming the stencil without substantially contracting the lateral width of the stencil that the cross sectional shape of the firming fold F is a V shape as shown in FIG. 5. However, although the V shape is generally desirable, the V shape need not be an exact V shape such that the stencil is folded at a bottom (or an apex) and at one ends of two legs of V so as to have three break points, but the V shape may be such that the stencil is folded only at the bottom (or apex) point with opposite leg portions being formed by a temporal arcuate bending of corresponding portions of the stencil effected by the sharp folding at the bottom or apex point. In this case, the stencil will show a cross sectional shape of a chain of shallow arcs on the outlet side of the rollers 40 and 42, still showing a substantially increased firmness as compared with a simple plane condition. However, the cross sectional shape of the firming folds are not limited to those described above.

Figure 2:
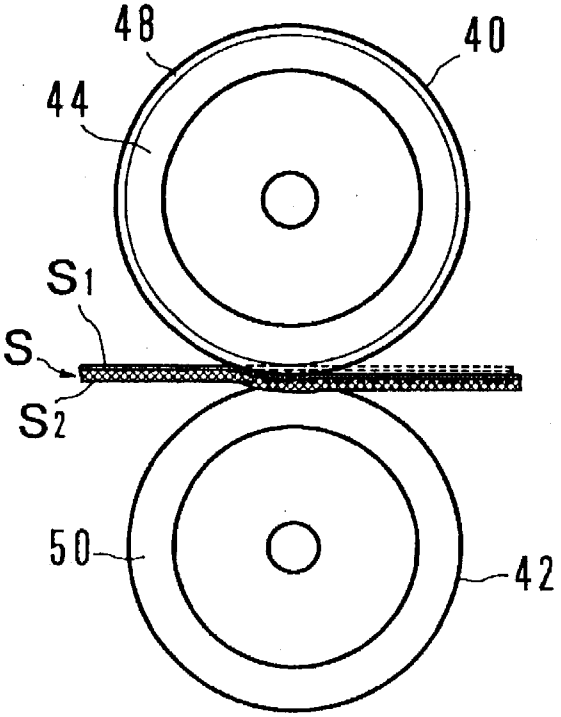
FIG. 2 is a diagrammatical side view showing an essential part of the firming fold application means of the rotary stencil printer shown in FIG. 1 with respect to an embodiment thereof.
Figure 3:
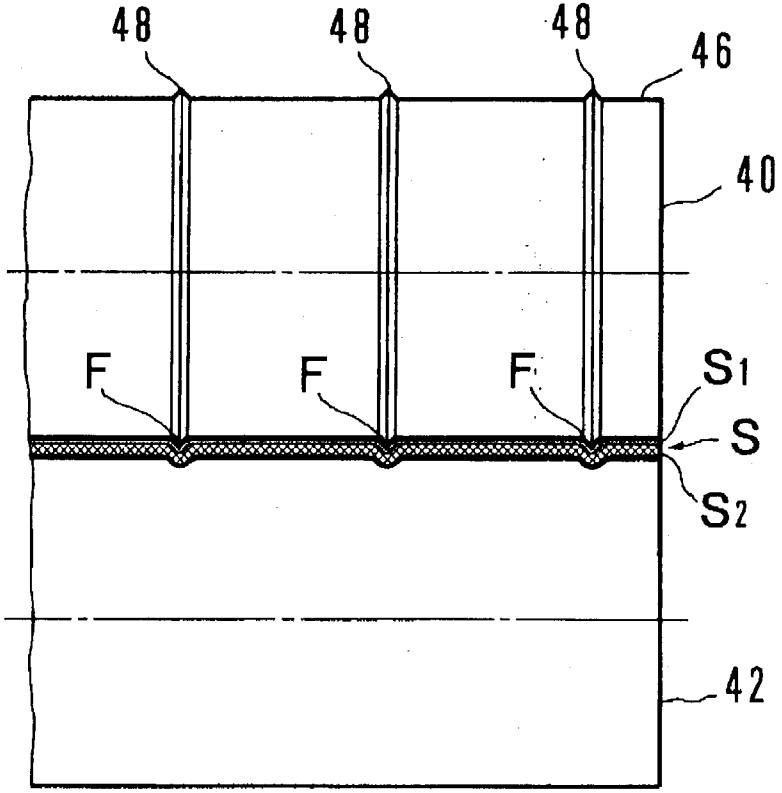
FIG. 3 is a partial front view corresponding to the construction shown in FIG. 2.
Figure 4:
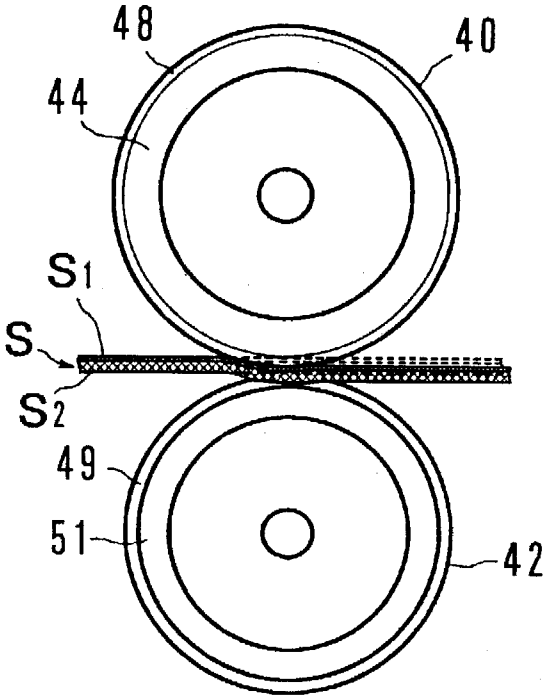
FIG. 4 is a diagrammatical side view showing an essential part of the firming fold application means of the rotary stencil printer shown in FIG. 1 with respect to another embodiment thereof.

In the embodiment shown in FIGS. 4 and 5, the roller 40 is the same as the roller 40 of the embodiment shown in FIGS. 2 and 3, whereas the roller 42 is formed with annular grooves 49 aligned with the projections 48 of the roller 40 to receive those projections therein. In this case, an outer circumferential portion 51 of the roller 42 may be made of a firm material such as a metal.

Also in FIGS. 4 and 5, the thickness of the stencil S is shown as substantially enlarged as compared with the rollers 40 and 42 for the clarity of illustration, and therefore the width and the depth of the groove 49 are shown to be substantially greater than the width and the depth of the projection 48, although the cross sectional shape of the projection 48 and the groove 49 are not so different as shown in the figure, because the thickness of the stencil is very small such as about 40 microns.

In the embodiment shown in FIG. 1, the roller 40 is rotatably supported at an end of a pair of arm members 54 which are pivotably supported by a pivot shaft 52 supported from a housing, not shown in the figure, of the rotary stencil printer, so as to be movable between a position pressed against the roller 42 as shown in the figure and a position removed from the roller 42. In more detail, the arm members 54 are exerted with a biasing force of springs 56 which are connected at one end thereof to arm members and connected at the other end thereof to said housing not shown in the figure in the direction to remove the roller 40 away from the roller 42, and there are provided solenoid actuators 58 adapted to act at the other ends of the arm members 54 so as to turn, when energized, the arm members 54 around the pivot shaft 52 anti-clockwise against the biasing force of the springs 56 so as to press the roller 40 against the roller 42. The roller 42 is adapted to be driven for rotation in synchronization with the stencil feed rollers 36 so that, when the stencil is to be fed through the pairs of the rollers 36 and the rollers 40 and 42 as shown in FIG. 1, the roller 42 and the pair of rollers 36 are driven by a driving means not shown in the figure according to a predetermined controlled manner so as to feed, in cooperation, the stencil toward the cylindrical printing drum 10. Therefore, when the stencil is fed through the rollers 40 and 42 while the solenoid actuator 58 is being operated, the stencil is formed with the firming folds by the projections 48.

A stencil cut means 60 is provided between the stencil feed means and the printing drum. The stencil cut means comprises a lower stationary edge 62 and an upper movable edge 64 vertically movable relative to the stationary edge. When the movable edge 64 is moved downward in the figure, the stencil is cut along the engagement of the stationary and movable edges.

The other constructions of the rotary stencil printer shown in FIG. 1 are those conventional to the rotary stencil printer of this type. In detail, 66 is a back press roller for pressing a print sheet against the cylindrical printing drum 10 during printing, adapted to be selectively moved up and down by a back press roller operation means 68, in synchronization with the rotation of the cylindrical printing drum 10 and in response to supply of a print sheet from a print sheet supply means described hereinbelow, so as to press the print sheet against the printing drum. 70 is the print sheet supply means, comprising a print sheet support plate 72 supporting a stack of print sheet P and gradually movable upward according to consumption of the print sheet, a print sheet feed out roller 74 for feeding out the uppermost print sheet of the stack thereof one by one, a print sheet separation roller 76, and a pair of timing rollers 78 for feeding the print sheet in synchronization with the rotation of the printing drum 10.

The print sheet pressed against the cylindrical printing drum 10 bearing a perforated stencil therearound by the back press roller 60 and given a print image thereon is separated from the printing drum as it moves accompanying the rotation of the printing drum on the way thereof by a separation claw 80 adapted to engage the leading edge thereof, and is collected by a print sheet discharge means 82 which further comprises a belt conveyer 84 for transporting the print sheet separated by the separation claw 80 starting from the leading end, a vacuum chamber 86 for applying a vacuum to the rear side of the belt conveyer 84 to attract the print sheet onto the upper surface of the belt conveyer, and a print sheet collection tray 88.

After the completion of the printing, the used stencil is, when the cylindrical printing drum 10 is rotated with the clamp plate 16 of the stencil leading end mounting means 12 turned open, peeled off from the printing drum, starting from its leading edge by a stencil separation claw 92 of a stencil disposal means 90, and fed through a pair of stencil disposal rollers 94 toward and into a stencil disposal box 96.

In the state shown in FIG. 1, the solenoid actuators 58 of the firming fold application means 38 are being actuated so that the roller 40 is pressed against the roller 42, while the stencil feed means 18 is being operated, with the cylindrical printing drum 10 being positioned at the standby position with the clamp plate 16 turned open to receive the leading end of the stencil, such that the leading end of the stencil fed toward the stencil leading end mounting means 12 has just reached it. The movable edge 64 of the stencil cut means 60 is lifted above the stationary edge 62. When the leading end portion of the stencil has reached the base 14 and is fastened thereon by the clamp plate 16, the cylindrical printing drum is started to rotate anti-clockwise, and in synchronization therewith the pair of rollers 36 of the stencil feed means 18 are rotated in the stencil feeding direction, whereby the stencil is progressively mounted around the cylindrical printing drum starting from the leading end thereof in an expanded condition. In such a stencil mounting process, the firming fold application means 38 is, when the leading end of a required length has been formed with the firming folds, ceased to operate by the solenoid actuators 58 being deenergized so that the roller 40 is removed from the roller 42 by the biasing action of the springs 56, ending the action of forming the firming folds in the stencil.

Figure 6:
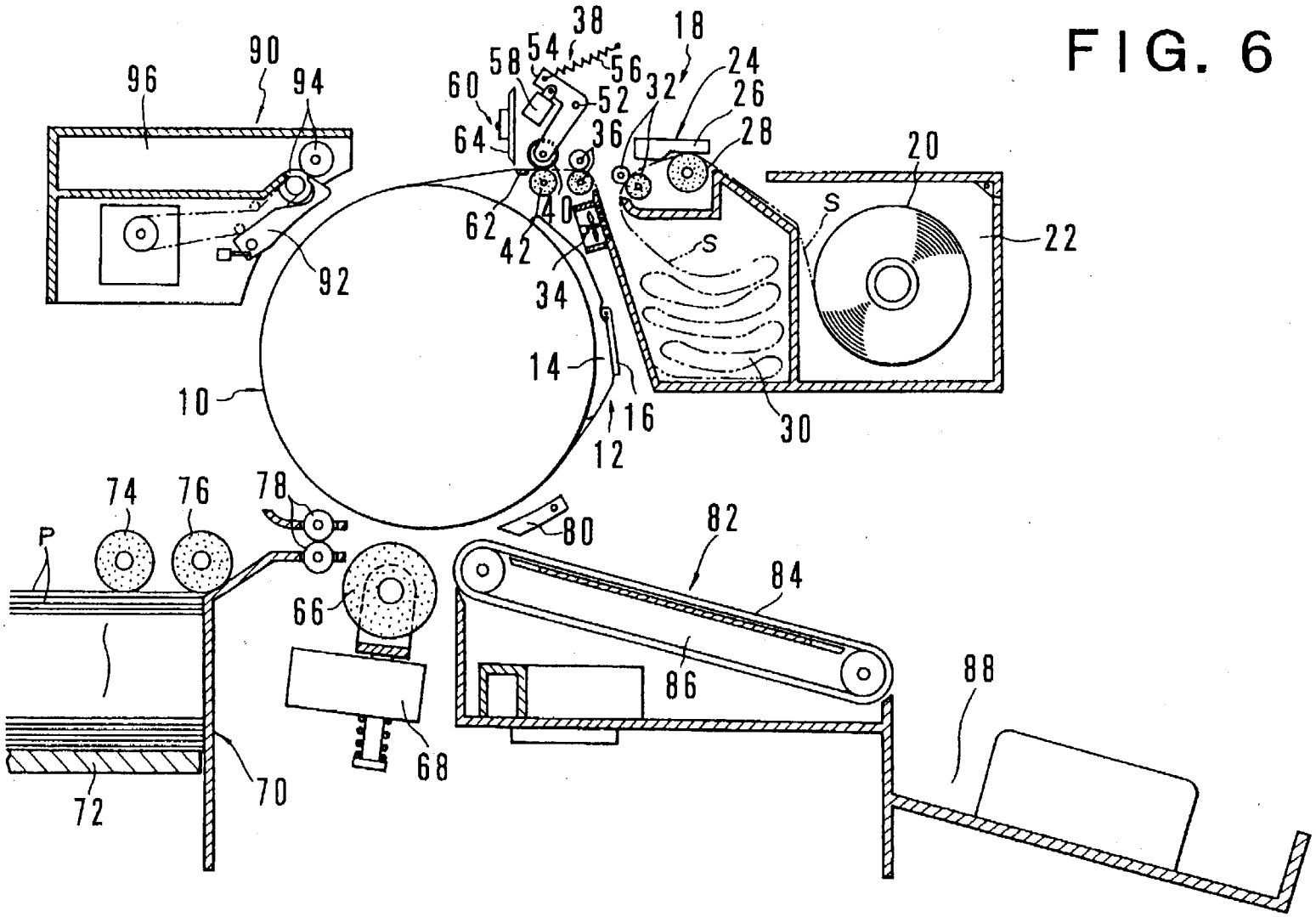
FIG. 6 is a view similar to FIG. 1, showing the operating condition of the rotary stencil printer shown in FIG. 1 at another time point of operation.

When the process of mounting the stencil around the cylindrical printing drum approaches the end thereof as shown in FIG. 6 such that a predetermined length of the trailing end of a one sheet part of the stencil mounted around the cylindrical printing drum starts to pass over the roller 42, the solenoid actuators 58 are again energized to press the roller 40 against the roller 42, so as thereby to restart the application of the firming folds to the stencil. Thereafter, when the trailing end of the one sheet part of the stencil comes to the position of the stencil cut means 60, the movable edge 64 is moved downward, to cut out the one sheet part of the stencil from the succeeding part of the stencil. At this moment, since there is a certain distance between the position of the edges of the blades 62 and 64 and the nipping portion of the rollers 40 and 42, a portion of the leading end of the stencil corresponding to this distance is already formed with the firming folds. This portion becomes a leading part of the leading end of the stencil over which the next firming fold application is applied.

Figure 7:
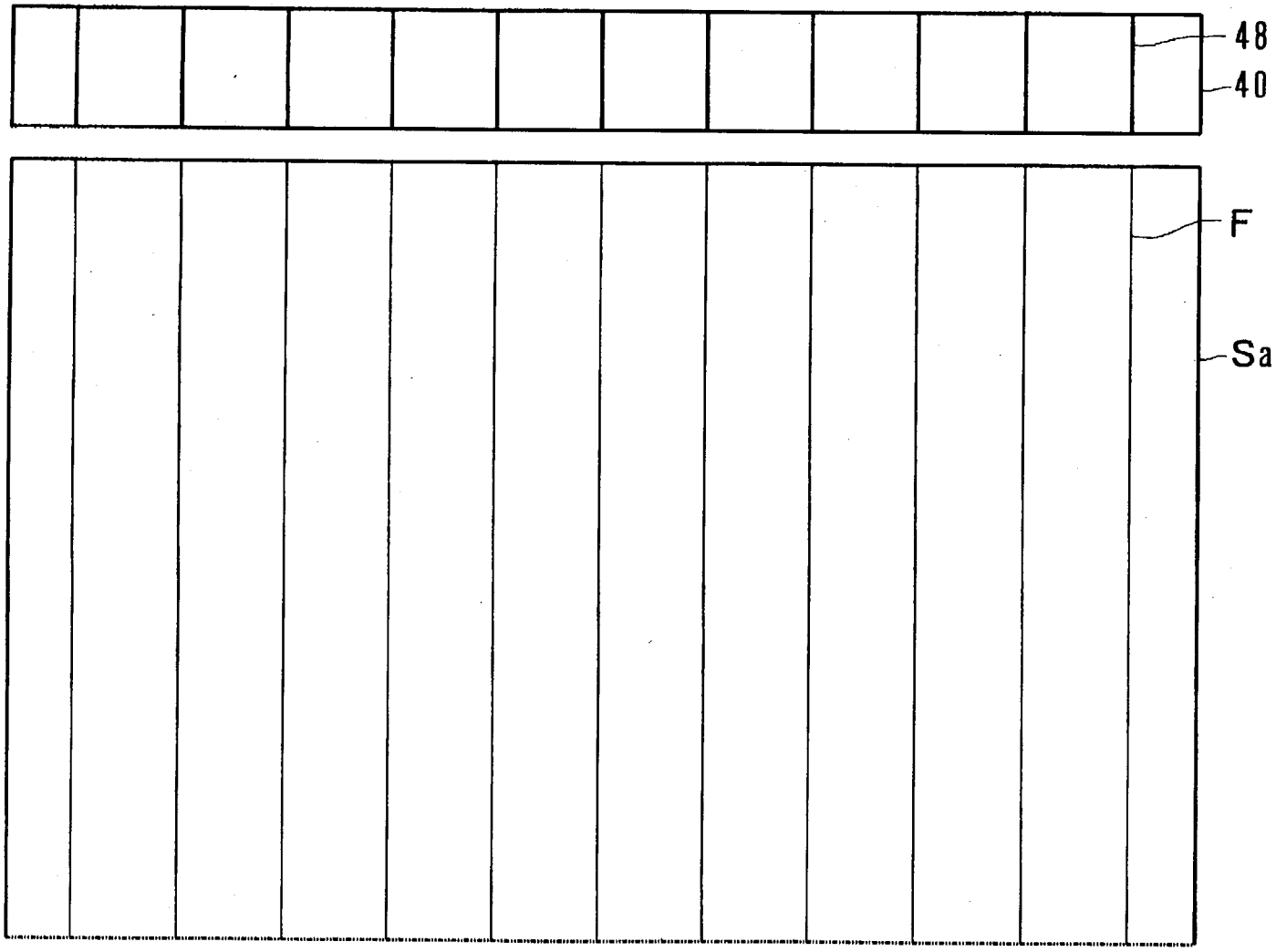
FIG. 7 is a plan view of the fold application roller shown in FIGS. 2 and 3 or FIGS. 4 and 5 and the pattern of the firming folds generated at the stencil leading end by this roller.

FIG. 7 shows how the firming folds are formed in the leading end of the stencil by a plurality of annular projections 48 each provided by an annular convex extending in a circle around the central axis of the roller 40 as shown in FIGS. 2 and 3 or FIGS. 4 and 5. In FIG. 7, the fold application roller 40 is diagrammatically shown in a plan view at an upper portion thereof, wherein lines 48 are the diagrammatical illustration of the fold application projections. The leading end Sa of the stencil is shown in a plan view, wherein lines F are the firming folds formed therein.

Figure 8:
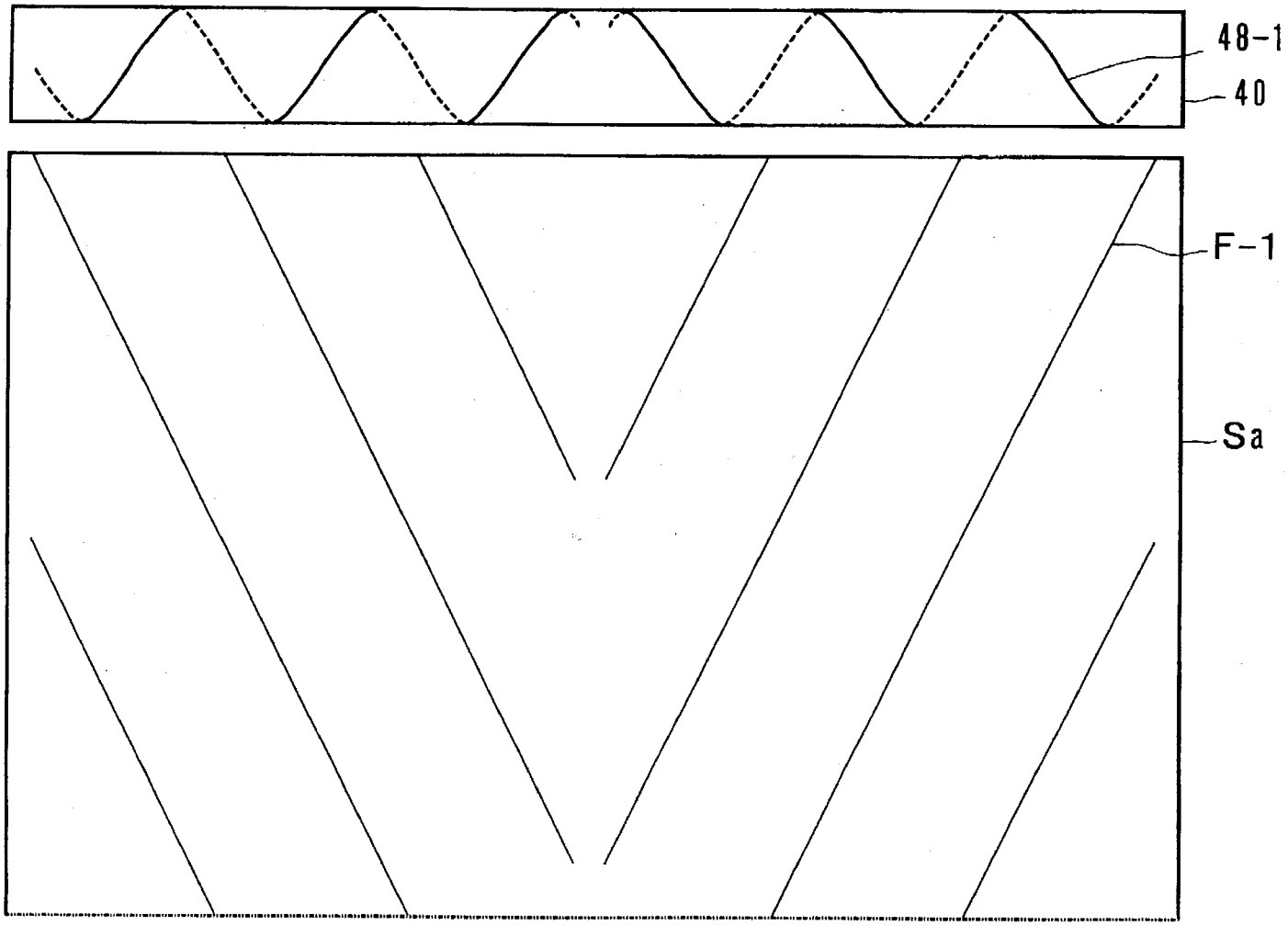
FIG. 8 is a plan view similar to FIG. 7, showing another embodiment of the fold application projections provided at the fold application roller and the pattern of the firming folds generated at the stencil leading end by those fold application projections.

FIG. 8 is a view similar to FIG. 7, showing another embodiment with regard to the pattern of the firming folds. In this embodiment, the fold application roller 48 is provided with a helical convex 48-1 virtually providing a plurality of projections dispersed in the axial direction of the roller, by which the leading end portion Sa of the stencil is formed with firming folds F-1 inclined relative to the longitudinal direction of the stencil.

Figure 9:
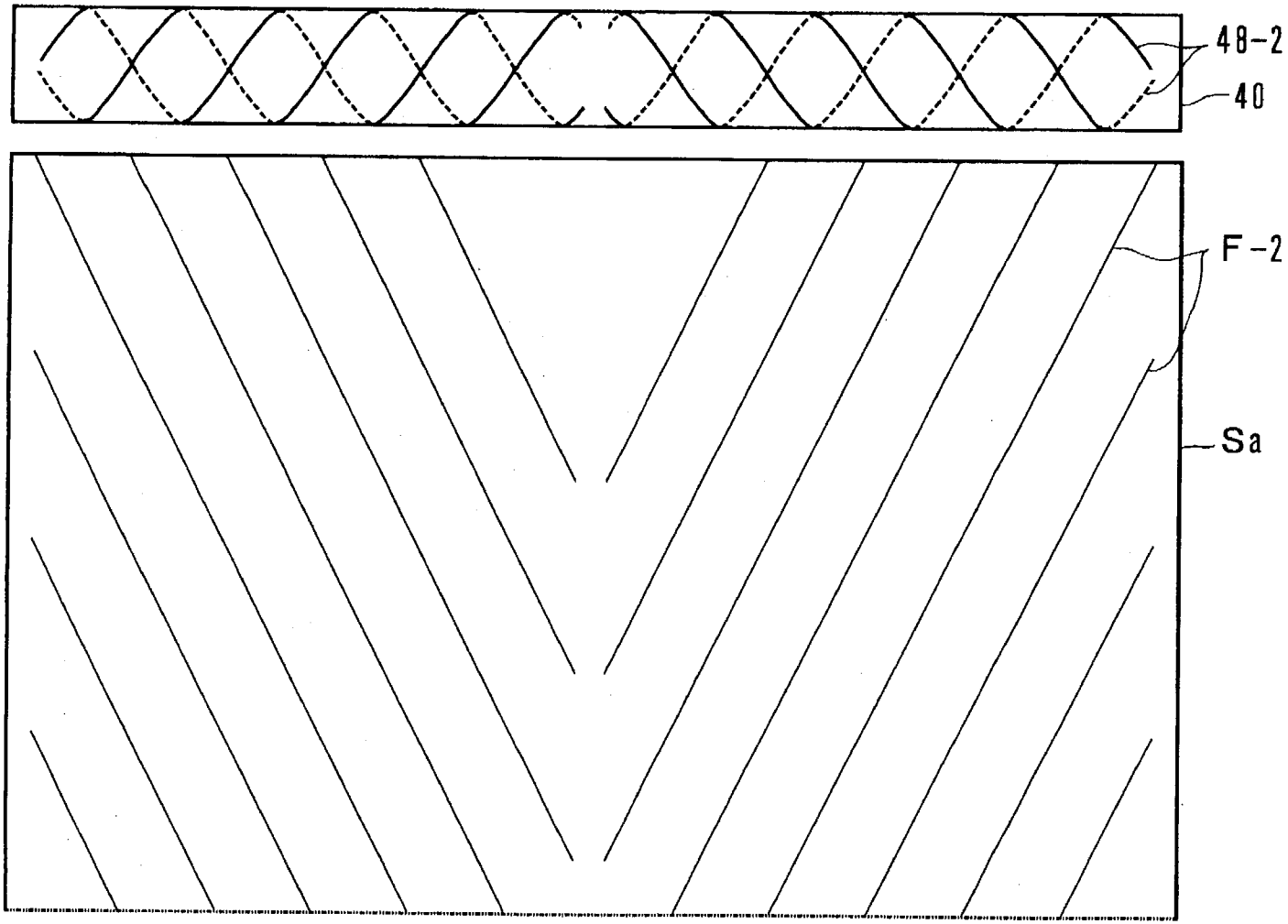
FIG. 9 is a plan view similar to FIGS. 7 and 8, showing still another embodiment of the fold application projections provided at the fold application roller and the pattern of the firming folds generated at the stencil leading end by those fold application projections.

FIG. 9 is a view similar to FIGS. 7 and 8, showing still another embodiment with regard to the pattern of the firming folds. In this embodiment, the fold application roller 48 is provided with a one more helical convex in addition to the helical convex provided in the embodiment shown in FIG. 8 as axially shifted therefrom, so that the convexes are formed as double helical convexes 48-2 virtually providing a plurality of projections dispersed at a double density in the axial direction of the roller, by which the leading end Sa of the stencil is formed with inclined folds F-2 similar to those of the embodiment of FIG. 8 but at a density twice as much.

Figure 10:
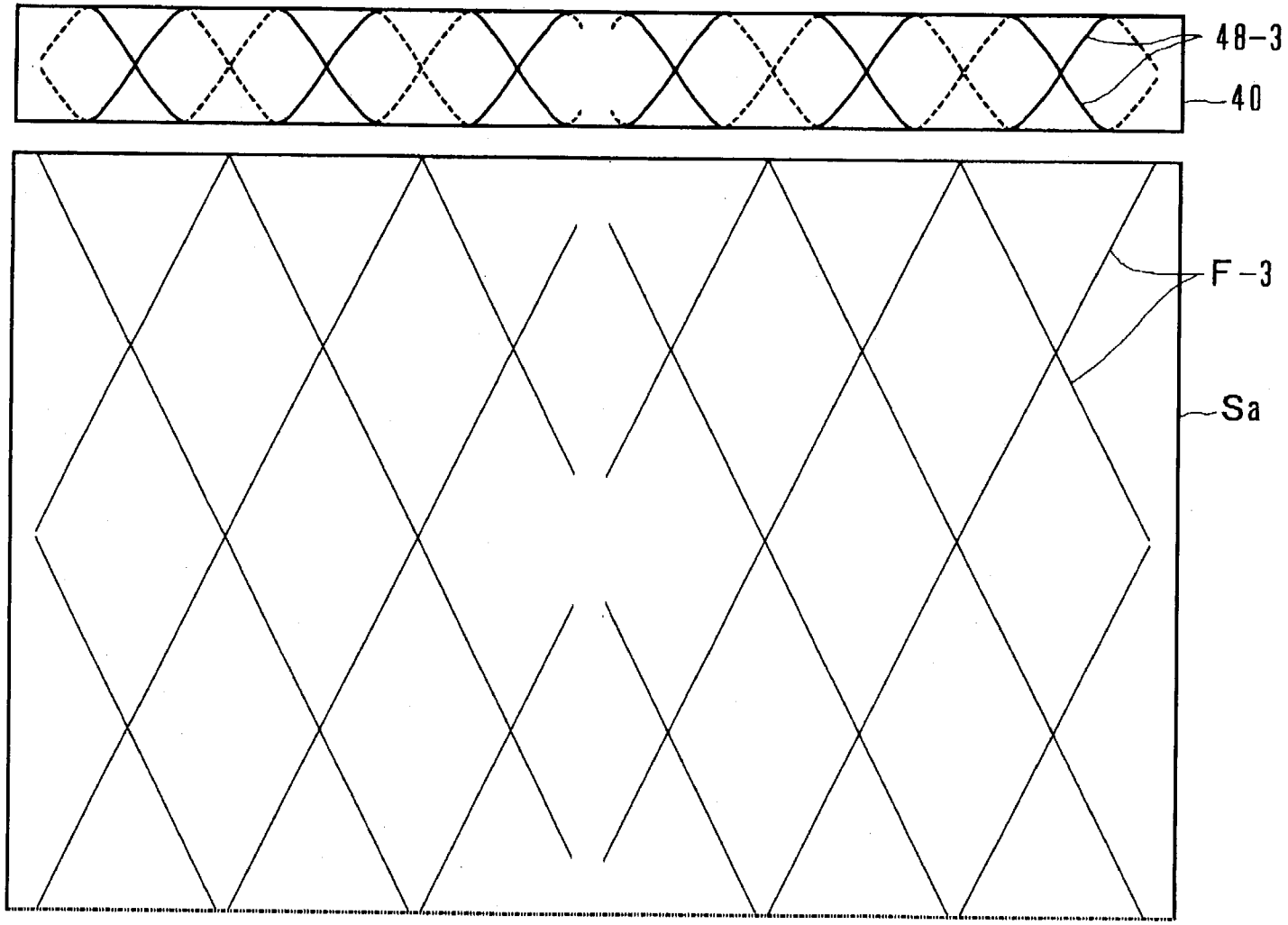
FIG. 10 is a plan view similar to FIGS. 7–9, showing still another embodiment of the fold application projections provided at the fold application roller and the pattern of the firming folds generated at the stencil leading end by those fold application projections.

FIG. 10 is a view similar to FIGS. 7–9, showing still another embodiment with regard to the pattern of the firming folds. In this embodiment, the fold application roller 40 is formed with a one more helical convex in addition to that of the embodiment of FIG. 8 but in a direction opposite to that of the first helical projection, so that the roller is formed with a pair of crossing helical convexes 48-3, by which the leading end Sa of the stencil is formed with two groups of oppositely inclined firming folds F-3.

Figure 11:
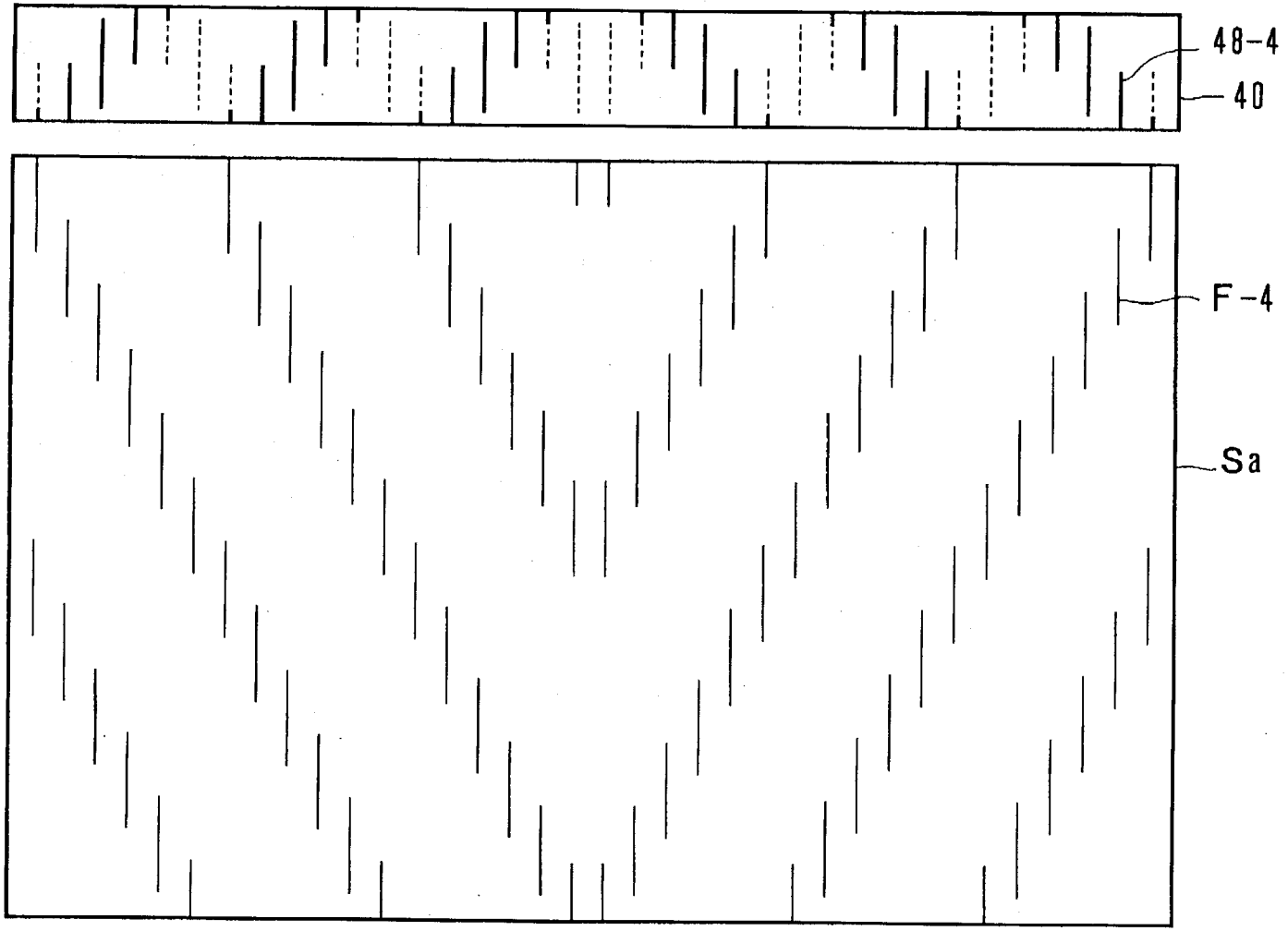
FIG. 11 is a plan view similar to FIGS. 7–10, showing still another embodiment of the fold application projections provided at the fold application roller and the pattern of the folds generated at the stencil leading end by those fold application projections.

FIG. 11 is a view similar to FIGS. 7–10, showing still another embodiment with regard to the pattern of the firming folds. In this embodiment, the fold application roller 40 is formed with a number of arcuate fold application projections 48-4 each extending in a plane perpendicular to the central axis of the fold application roller 40 over about one third of the full circumference as spaced along the central axis thereof such that each two adjacent arcuate projections are circumferentially shifted from one another as much as one sixth of the full circumference, by which the leading end Sa of the stencil is formed with firming grooves F-4 which, each extending in the longitudinal direction of the stencil, provide, in combination, a plurality of groups of the firming folds each group generally extending as inclined with respect to the longitudinal direction of the stencil.

Figure 12:
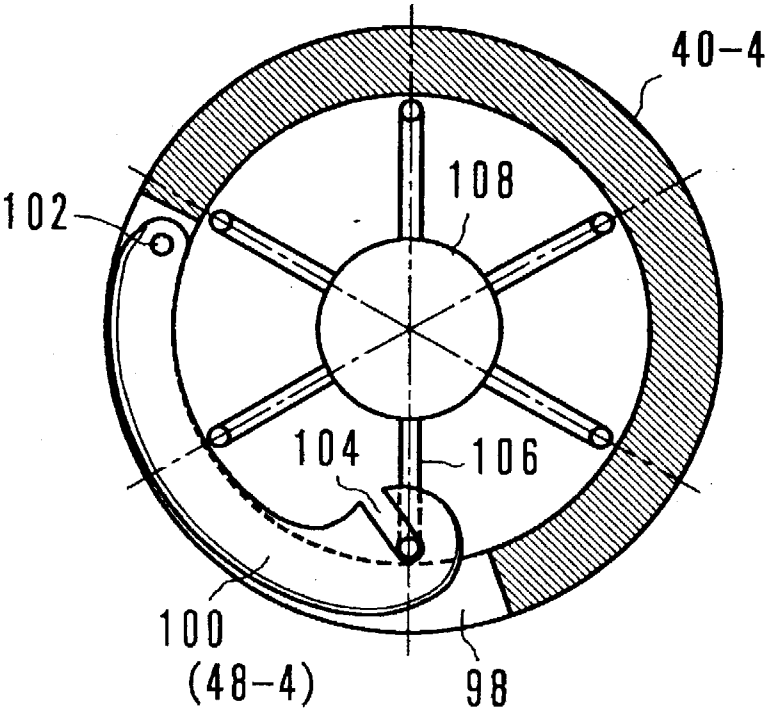
FIG. 12 is a somewhat diagrammatical sectional view showing an embodiment of the pattern application roller incorporating a structure to make the fold application projections in the fold application roller shown in FIG. 9 to be movable between an operating position and a non-operating position, the figure being a section along line XII—XII in FIG. 13 and viewed in the direction of arrows.
Figure 13:
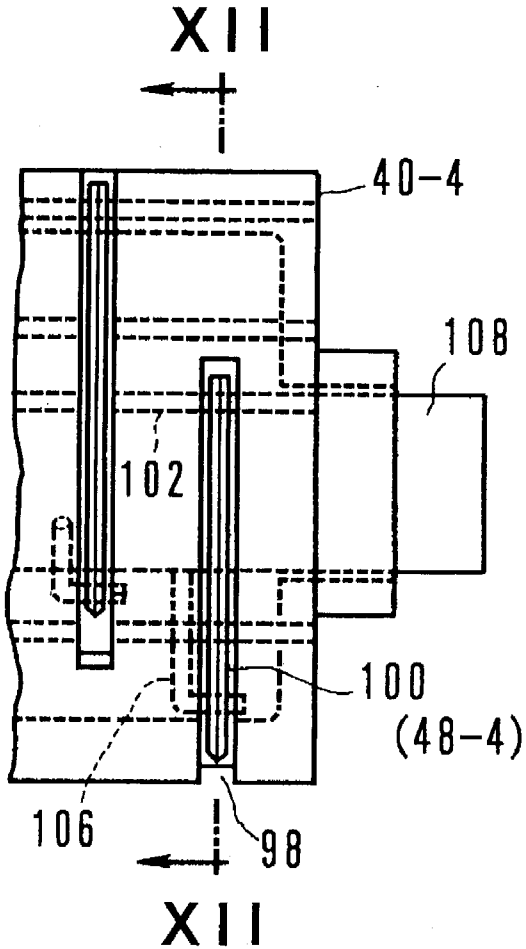
FIG. 13 is a front view showing a part of the fold application roller shown in FIG. 12.

FIGS. 12 and 13 show an embodiment of a fold application roller 40 having such arcuate projections 48-4 for forming the firming folds as shown in FIG. 11, in which the arcuate projections are each provided by a blade piece adapted to be movable between an operating position raised from the cylindrical base surface of the roller and a non-operating position housed below the cylindrical base surface, in a cross sectional view and a front view, respectively, wherein FIG. 12 corresponds to a section along line XII—XII in FIG. 13 and viewed in the direction of arrows. In this embodiment, the fold application roller 40-4 whose principal portion is made of a tubular body is formed with slits 98 positioned to correspond to the arcuate projections 48-4, in each of which there is mounted an arcuate fold application blade piece 100 (corresponding to 48-4) to be pivotable at one end portion thereof by a pivot shaft 102. Each of the blade pieces 100 has a cam groove 104 at another end portion thereof. A rod 106 having a cam end engaged to the cam groove 104 is provided as radially supported from a cam shaft 108 arranged along the central axis of the fold application roller 40-4. The blade piece 100 and the cam rod 106 having the construction as shown in FIG. 12 are arranged in plurality as spaced along the central axis of the fold application roller 40-4, with a relative angular shifting of one sixth of the full circumference between each two adjacent ones.

Figure 14:
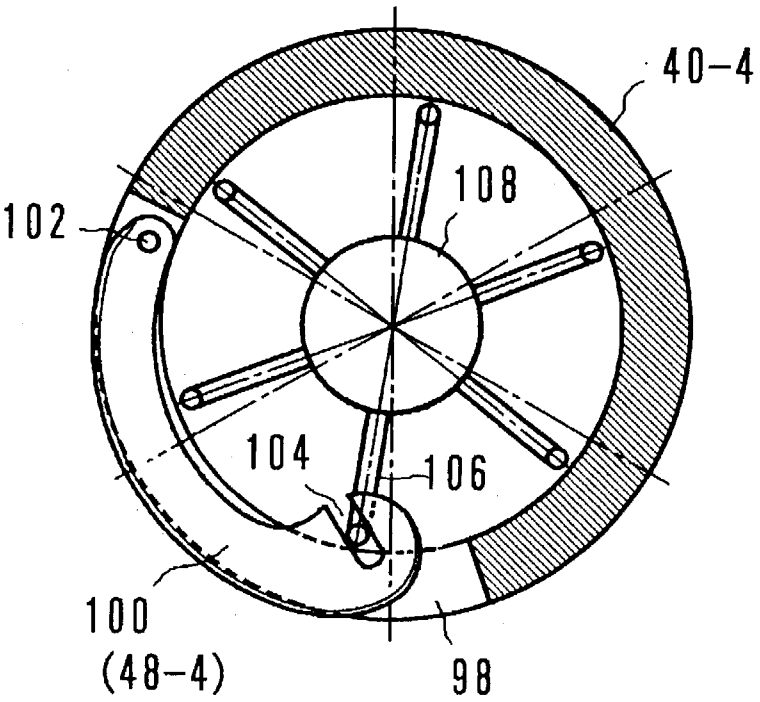
FIG. 14 is a view similar to FIG. 12, showing the fold application roller of FIG. 12 in the operating condition, the figure being a section along line XIV—XIV in FIG. 15 and viewed in the direction of arrows.
Figure 15:
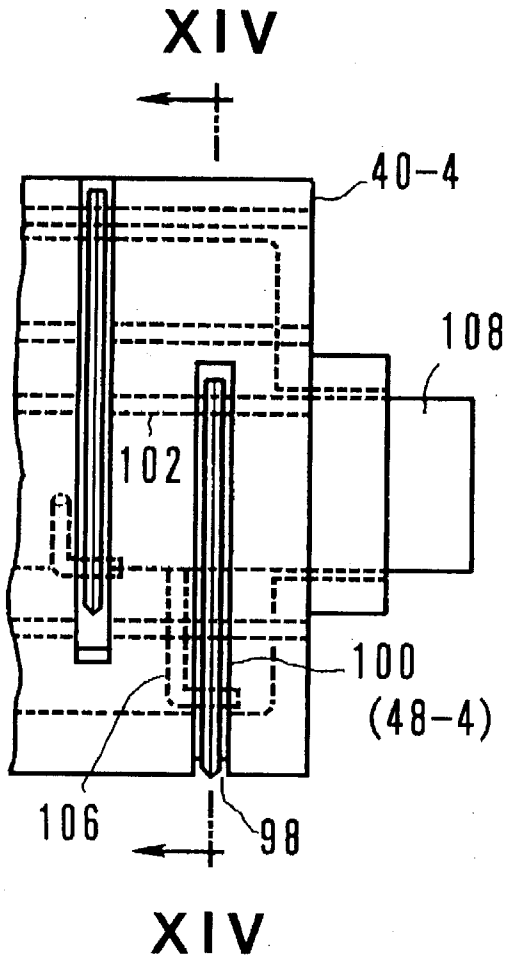
FIG. 15 is a front view of a part of the fold application roller corresponding to FIG. 14.

In the fold application roller of the above-mentioned construction, when the cam shaft 108 is in a rotational position relative to the tubular body of the roller as shown in FIG. 12, each blade piece 100 is housed in the slit 98 so as not to project from the cylindrical circumferential surface of the body of the roller, whereas when the cam shaft 108 is rotated relative to the tubular body of the shaft as shown in FIGS. 14 and 15, each blade piece 100 projects from the cylindrical base surface of the roller to be in an operating position thereof so as to provide folds application projections corresponding to the projections 48-4 shown in FIG. 11.

When such a fold application roller having the fold application projections movable between the operating position projecting from the cylindrical base surface of the roller and the non-operating position housed below the cylindrical base surface thereof is employed for the firming fold application means, then viewing in FIG. 1 it is possible to omit the pair of stencil feed rollers 36, so that the stencil is always fed by the pair of rollers 40 and 42 with or without the firming folds being generated during the feeding. By the pair of rollers 40 and 42 being thus provided with the function of feeding the stencil without generating the firming folds thereat, in the construction shown in FIG. 1 the position of the stencil feed rollers, which are now provided by the rollers 40 and 42 while omitting the rollers 36, can be virtually more shifted toward the stencil leading end mounting means 12 positioned at the standby position. Thus, when the length of the stencil fed out from the stencil feed rollers 36 until the moment at which the leading end of the stencil is clamped by the clamp plate 16 at the stencil leading end mounting means 12 is longer than the length along which the firming folds may be generated (in other words, when the firming folds would be formed for too great a length if the firming folds are formed over the entire length of the stencil fed out from the stencil feed rollers 36 until the moment at which the leading end of the stencil is clamped by the clamp plate 16 at the stencil leading end mounting means 12). Therefore, the firming folds can not be formed over the entire length of the stencil which must fly depending on its self firmness for the stencil leading end to reach the stencil leading end mounting means, the pair of rollers 40 and 42, if these operate as the stencil feed rollers, are closer to the stencil leading end mounting means positioned, and therefore, even when the firming folds application means according to the present invention is provided, the pair of the stencil feed rollers need not be virtually shifted away from the stencil leading end mounting means positioned at the standby position, so that the feed of the stencil leading end is more stabilized.

It will be apparent for those skilled in the art that various modifications are possible with respect to the shown embodiments within the scope of the present invention.

We claim:

1. A rotary stencil printer comprising a cylindrical printing drum equipped with a stencil leading end holding means provided at a part of an outer circumferential surface thereof along a generatrix thereof and adapted to carry a sheet of stencil as mounted therearound with a leading end thereof being held by said stencil leading end holding means, and a stencil feed means for feeding said sheet of stencil starting from the leading end thereof toward said stencil leading end holding means of said printing drum positioned at a standby position for mounting said sheet of stencil around said printing drum, wherein said stencil feed means comprises a firming fold application means for generating firming folds at least at either a leading end portion or a trailing end portion of said sheet of stencil, and a means for synchronizing the firming folds generation of said firming fold application means with the stencil sheet feeding of said stencil feed means such that the firming folds are generated at least at either the leading end portion or the trailing end portion of said sheet of stencil.

2. A rotary stencil printer according to claim 1, further comprising a stencil cut means provided between said printing drum and said stencil feed means, said stencil cut means being operationally correlated with said stencil feed means such that when said stencil feed means feeds out one sheet part of a continuous stencil adapted to provide a plurality of sheets of stencil, said stencil cut means cuts the continuous stencil at the end of feeding out of said one sheet part thereof, wherein said firming fold application means generates said firming folds at a portion of the continuous stencil extending across a position thereof at which the continuous stencil is cut by said stencil cut means.

3. A rotary stencil printer according to claim 1, wherein said firming fold application means comprises a pair of rollers including first and second rollers, said first roller having projections provided at a portion of an outer circumferential surface thereof to project from a cylindrical base surface thereof.

4. A rotary stencil printer according to claim 3, wherein said second roller has an elastic cylindrical outer surface adapted to accept said projections of said first roller by an elastic local deformation thereof when said elastic cylindrical outer surface of said second roller is approached to said cylindrical base surface of said first roller such that said pair of rollers construct a feed roller means for feeding the stencil by holding the stencil therebetween.

5. A rotary stencil printer according to claim 3, wherein said second roller has grooves at a portion of an outer circumferential surface thereof to be concaved from a cylindrical base surface thereof, said pair of rollers constructing a feed roller means for feeding the stencil by holding the stencil therebetween with said projections being aligned and engaged with said grooves.

6. A rotary stencil printer according to claim 3, wherein said first roller comprises a mechanism for moving said projections between an operating position thereof projecting from said cylindrical base surface thereof and a non-operating position housed below said cylindrical base surface thereof.

7. A rotary stencil printer according to claim 3, wherein said projections of said first roller comprise projections provided by annular convexes each extending along a circle around a central axis of said first roller.

8. A rotary stencil printer according to claim 3, wherein said projections of said first roller comprise projections provided by a helical convex extending around a central axis of said first roller.

9. A rotary stencil printer according to claim 3, wherein said projections of said first roller comprise projections provided by two helical convexes extending in parallel with one another around a central axis of said first roller.

10. A rotary stencil printer according to claim 3, wherein said projections of said first roller comprise projections provided by two helical convexes extending in opposite directions against one another around a central axis of said first roller.

11. A rotary stencil printer according to claim 3, wherein said projections of said first roller comprise projections provided by arcuate projections each extending along a part of a circle around a central axis of said first roller, wherein each two adjacent ones of said arcuate projections are shifted axially as well as circumferentially from one another.

12. A rotary stencil printer comprising a cylindrical printing drum equipped with a stencil leading end holding means provided at a part of an outer circumferential surface thereof along a generatrix thereof and adapted to carry a sheet of stencil as mounted therearound with a leading end thereof being held by said stencil leading end holding means, and a stencil feed means for feeding said sheet of stencil starting from the leading end thereof toward said stencil leading end holding means of said printing drum positioned at a standby position for mounting said sheet of stencil around said printing drum, wherein said stencil feed means comprises a firming fold application means for generating firming folds at least at either a leading end portion or a trailing end portion of said sheet of stencil, wherein said firming fold application means comprises a pair of rollers including first and second rollers, said first roller having projections provided at a portion of an outer circumferential surface thereof to project from a cylindrical base surface thereof, wherein said first roller comprises a mechanism for moving said projections between an operating position thereof projecting from said cylindrical base surface thereof and a non-operating position housed below said cylindrical base surface thereof.

13. A rotary stencil printer comprising a cylindrical printing drum equipped with a stencil leading end holding means provided at a part of an outer circumferential surface thereof along a generatrix thereof and adapted to carry a sheet of stencil as mounted therearound with a leading end thereof being held by said stencil leading end holding means, and a stencil feed means for feeding said sheet of stencil starting from the leading end thereof toward said stencil leading end holding means of said printing drum positioned at a standby position for mounting said sheet of stencil around said printing drum, wherein said stencil feed means comprises a firming fold application means for generating firming folds at least at either a leading end portion or a trailing end portion of said sheet of stencil, wherein said firming fold application means comprises a pair of rollers including first and second rollers, said first roller having projections provided at a portion of an outer circumferential surface thereof to project from a cylindrical base surface thereof, wherein said projections of said first roller comprise at least one member selected from the group consisting of:

projections provided by a helical convex extending around a central axis of said first roller;

projections provided by two helical convexes extending in parallel with one another around a central axis of said first roller;

projections provided by two helical convexes extending in opposite directions against one another around a central axis of said first roller; and projections provided by arcuate projections each extending along a part of a circle around a central axis of said first roller, wherein each two adjacent ones of said arcuate projections are shifted axially as well as circumferentially from one another.

14. A rotary stencil printer according to claim 13, wherein said projections of said first roller comprise:

projections provided by said helical convex extending around said central axis of said first roller.

15. A rotary stencil printer according to claim 13, wherein said projections of said first roller comprise:

projections provided by two helical convexes extending in parallel with one another around said central axis of said first roller.

16. A rotary stencil printer according to claim 13, wherein said projections of said first roller comprise:

projections provided by two helical convexes extending in opposite directions against one another around said central axis of said first roller.

17. A rotary stencil printer according to claim 13, wherein said projections to said first roller comprise:

projections provided by arcuate projections each extending along said part of said circle around said central axis of said first roller, wherein each two adjacent ones of said arcuate projections are shifted axially as well as circumferentially from one another.

* * * * *